US006241418B1

(12) United States Patent
Suzuki et al.

(10) Patent No.: US 6,241,418 B1
(45) Date of Patent: Jun. 5, 2001

(54) DEVICE FOR BLOCKING EXIT OF CAR FROM PARKING LOT

(75) Inventors: Masaru Suzuki; Tosio Kurotsu; Ryoyu Fuyou, all of Urawa (JP)

(73) Assignee: The Nippon Signal Co., Ltd., Tokyo (JP)

( * ) Notice: Subject to any disclaimer, the term of this patent is extended or adjusted under 35 U.S.C. 154(b) by 0 days.

(21) Appl. No.: 09/214,828

(22) PCT Filed: Jun. 17, 1998

(86) PCT No.: PCT/JP98/02682

§ 371 Date: Jun. 15, 1999

§ 102(e) Date: Jun. 15, 1999

(87) PCT Pub. No.: WO99/00566

PCT Pub. Date: Jan. 7, 1999

(30) Foreign Application Priority Data

Jun. 27, 1997 (JP) ..... 9-172163

(51) Int. Cl.[7] ..... E01F 13/00; E01F 15/00
(52) U.S. Cl. ..... 404/6; 49/49
(58) Field of Search ..... 49/35, 49, 131; 404/6, 9

(56) References Cited

U.S. PATENT DOCUMENTS 2,229,183 * 1/1941 Mitchell .
3,667,160 6/1972 Salloum .
3,757,916 9/1973 Selby .
3,805,448 * 4/1974 Carr et al. ..... 49/49
3,838,760 * 10/1974 Selby, Jr. ..... 49/35
3,849,936 * 11/1974 Geraci ..... 49/35
3,948,375 4/1976 Selby, Jr. .
5,146,710 * 9/1992 Caldwell ..... 49/35

FOREIGN PATENT DOCUMENTS 2 411 433 9/1974 (DE) .
51-68946 6/1976 (JP) .
56-10831 3/1981 (JP) .
63-201159 12/1988 (JP) .
1-54509 11/1989 (JP) .
7-301020 11/1995 (JP) .

* cited by examiner

*Primary Examiner*—Thomas B. Will
*Assistant Examiner*—Gary S. Hartmann
(74) *Attorney, Agent, or Firm*—McDermott, Will & Emery

(57) ABSTRACT

An apparatus for blocking a parking vehicle from leaving, enabling a driver to confirm the locking board which is in the elevated state, and preventing the vehicle from leaving in an unauthorized manner. The apparatus does not employ any constitution for directly driving an auxiliary locking board using drive device, and the auxiliary locking board can be installed at a position remote from a main locking board.

10 Claims, 6 Drawing Sheets

(A)

(B)

(A)

(B)

DEVICE FOR BLOCKING EXIT OF CAR FROM PARKING LOT

BACKGROUND OF THE INVENTION

1. Field of the Invention

The present invention relates to an apparatus for blocking a parking vehicle from leaving, used in a nonattended toll parking lot and, more particularly, to for preventing a parking vehicle from leaving in an unauthorized manner.

2. Background Art

In a nonattended toll parking lot, as shown in FIGS. 6 and 7, there has heretofore been used a parking apparatus equipped with a parking fee receiving apparatus 1 and a leave-blocking apparatus 3 which locks a parking vehicle by means of a locking board 2.

In the leave-blocking apparatus 3 shown in FIG. 6, the locking board 2 is disposed between the front tires and rear tires of a vehicle which is parking on a parking zone 4. In the leave-blocking apparatus 3 shown in FIG. 7, the locking board 2 is disposed at one end of the parking zone 4, i.e., disposed on the inlet side from where the vehicle comes in and goes out.

These apparatuses have been designed to block the vehicles from leaving by means of the locking board 2 that remains elevated unless a fee is paid for parking the car.

The apparatuses 3 for blocking the parking vehicle from leaving shown in FIGS. 6 and 7 have their merits and demerits. So far, however, the apparatus shown in FIG. 6 has been widely and predominantly used.

The greatest reason is because when the locking board 2 is disposed on the vehicle inlet side of the parking zone 4 as shown in FIG. 7, the driver may overlook the elevated state, i.e., the locked state of the locking board 2; and, accordingly, the driver may try to leave from the parking zone 4 in a state where the locking board 2 is elevated, therefore, much trouble occurs. When the locking board 2 is disposed between the front tires and the rear tires of the vehicle which is parking on the parking zone 4 as shown in FIG. 6, the driver is allowed to easily confirm the elevated state of the locking board 2 that is located near the driver's seat; i.e., the driver is less likely to leave the parking zone 4 in a state where the locking board 2 is elevated. Besides, even when the driver carelessly leaves the parking zone 4 in the state where the locking board 2 is elevated or leaves at a moment when the locking board 2 starts elevated as the time enters into a time for another charge, an elastic tire simply hits the locking board 2 without damaging the vehicle and, hence, causing less trouble.

So far, therefore, the leave-blocking apparatus of the type shown in FIG. 6 has been much used. Accompanying an increase in the number of large four-wheel drive vehicles called RVs (recreational vehicles) in recent years, however, an increasing number of vehicles are trying to leave in an unauthorized manner without paying the fee for the charged time.

The vehicle leaves in an unauthorized manner by treading and pushing down the elevated locking board 2 with the tire or riding over the locking board 2 when it cannot be pushed down. This can be easily done by a vehicle having tires of a large diameter or by a vehicle having a small road clearance for which the locking board is elevated by a limited amount.

The above-mentioned unauthorized leave can be better prevented by the system of FIG. 7 which closes the parking zone itself during the locking time than the system of FIG. 6 of which the locking board 2 is trod by the tires.

As described above, however, the system of FIG. 7 invites the occurrence of trouble, and makes it necessary to increase the depth of the parking zone 4 so that the locking board 2 will not be concealed under the vehicle body. Therefore, this system cannot be installed in a narrow place. In practice, therefore, the system of FIG. 6 has been much employed.

BACKGROUND OF THE INVENTION

The present invention was accomplished in order to solve the above-mentioned problems inherent in the prior art, and its object is to provide an apparatus for blocking a parking vehicle from leaving in an unauthorized manner without paying fees, enabling the state of the locking portion to be easily confirmed, eliminating the occurrence of trouble when the driver carelessly leaves or leaves while the locking board is being elevated, offering safety and high reliability.

An apparatus for blocking a parking vehicle from leaving of the present invention satisfies the following requirements (1) to (3):

(1) The driver is allowed to easily make sure the elevated state of the locking board.

(2) Troubles occur little despite the driver carelessly leaves or leaves while the locking board is being elevated.

(3) Unauthorized leave without paying fees is prevented.

Therefore, a first aspect of the present invention is concerned with an apparatus for blocking a parking vehicle from leaving, comprising a locking portion for locking the parking vehicle, and a drive device for selectively driving the locking portion into a locked state in which the locking portion is elevated after the vehicle has entered for parking and into an unlocked state in which the locking portion is lowered, wherein the locking portion is constituted by a plurality of locking boards.

Thus, the locking portion is constituted by a plurality of locking boards. That is, at least one of the plurality of locking boards is installed at a position remote from the tire and at least one of them is installed at a position very close to the driver's seat, i.e., at a position which will be run (passed) over by a tire. Accordingly, the elevated state of the locking board installed at a position run (passed) over by the tire can be easily confirmed by the driver, and trouble occurs little despite the driver carelessly leaves or leaves while the locking board is being elevated.

When the driver leaves in an unauthorized manner without paying fees, furthermore, the locking board installed at a position remote from the tire hits the vehicle body to prevent it from leaving.

In this case, the end of the locking board is formed to be downwardly bent so will not to bite into the lower part of the vehicle body and so will not to damage the vehicle body.

According to a second aspect of the present invention, the locking portion is constituted by a main locking board and an auxiliary locking board, the main locking board is interlocked to the drive device, and an interlocking device is provided to interlock the main locking board and the auxiliary locking board together so that the auxiliary locking board is actuated to be in the locked state or the unlocked state when the main locking board is driven by the drive device to be in the locked state or the unlocked state. Then, in addition to the function of the first invention, it is made possible to install the auxiliary locking board at a position remote from the main locking board without the need of employing the constitution for directly driving the auxiliary locking board by the drive device.

In this case, the interlocking device is so constituted as to interlock the main locking board and the auxiliary locking board together, so that the auxiliary locking board that has been actuated to be in the locked state can be actuated by the application of an external force to be in the unlocked state when the main locking board is driven to be in the locked state. Therefore, even when the auxiliary locking board is lowered being trod by the tire, the operation of the main locking board is not affected; i.e., the main locking board maintains the elevated locked state. This also prevents the vehicle from rising high and effectively prevents the vehicle from leaving in an unauthorized manner without paying fees.

Furthermore, the main locking board is disposed near the central portion of the parking zone with respect to the auxiliary locking board. Or, the auxiliary locking board has a lateral width larger than the lateral width of the main locking board. This makes it possible to prevent the main locking board from being intentionally trod by the tire and to prevent the vehicle from leaving in an unauthorized manner without paying fees.

Moreover, if a detection device is provided to detect that the auxiliary locking board has been pushed down to the unlocked position during the locking period, any attempt to leave in an unauthorized manner by treading the auxiliary locking board which is in the locked state can be detected. By using a detection signal, an alarm may be produced, or the detection signal may be output to an external unit to take a picture of the vehicle by means of a camera or the like.

If the driver dares to leave in an unauthorized manner, the auxiliary locking board is lowered by the tire but the main locking board is not lowered. Therefore, the end of the main locking board may bite into the lower part of the vehicle body. However, the end of the main locking board which is at least downwardly bent does not bite into the lower part of the vehicle body and does not damage the vehicle body.

BRIEF DESCRIPTION OF THE DRAWINGS

FIG. 5 is a diagram illustrating the whole constitution of a packing apparatus, wherein FIG. 5(A) is a plan view and FIG. 5(B) is a side view;

EMBODIMENTS OF THE INVENTION

Embodiments of the present invention will now be described.

Figure 5:
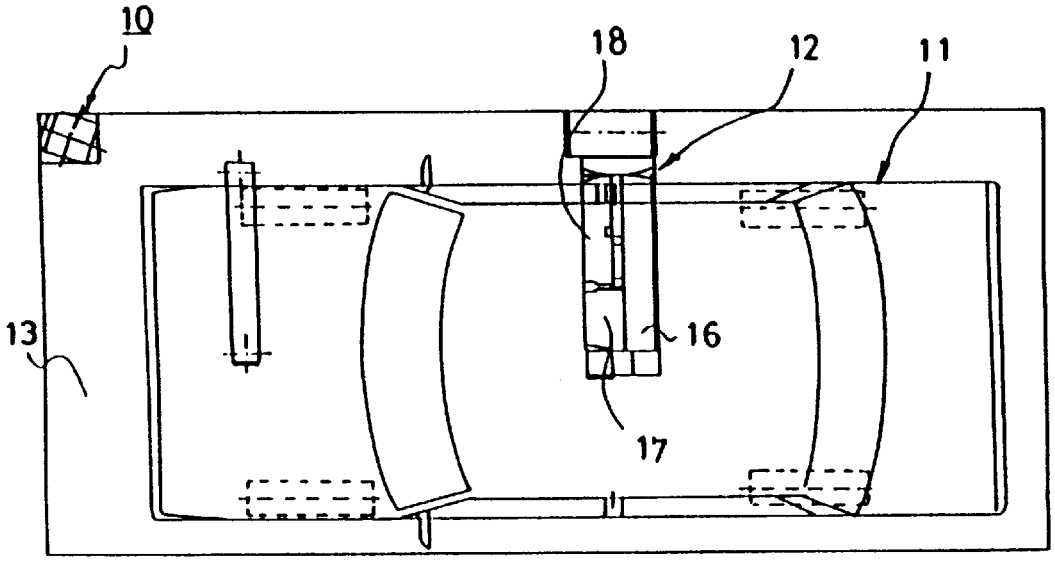
Figure 5:
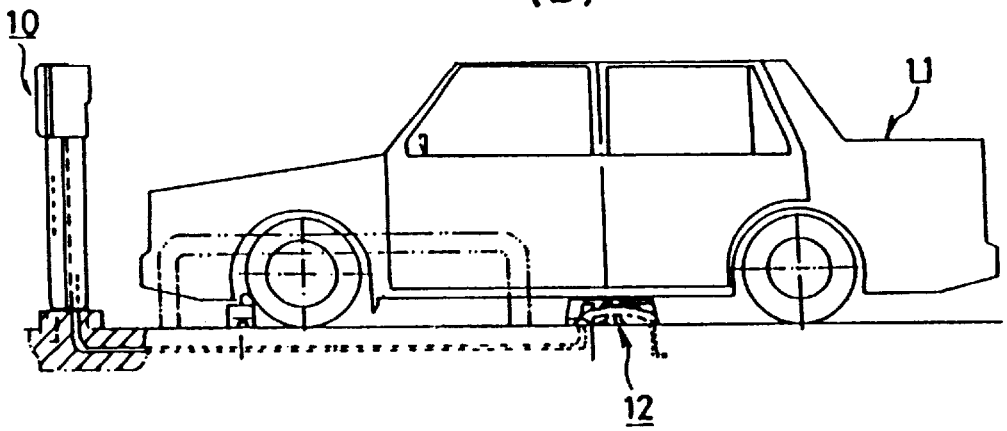
Figure 6:
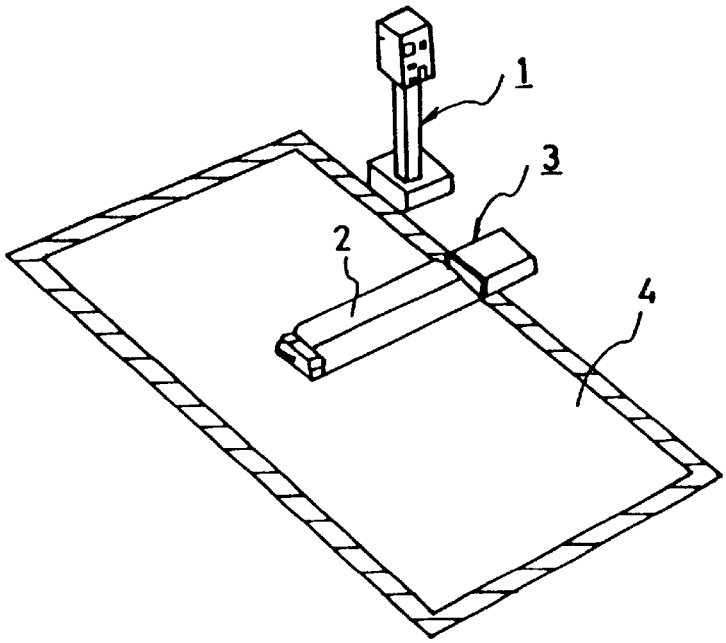
FIG. 6 is a perspective view illustrating a conventional apparatus for blocking a parking vehicle from leaving.
Figure 7:
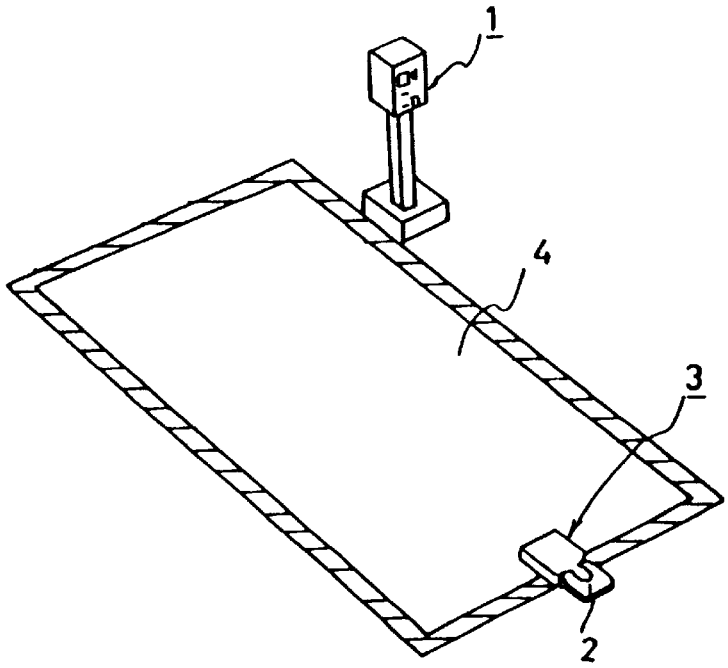
FIG. 7 is a perspective view illustrating another conventional apparatus for blocking a parking vehicle from leaving.

FIG. 5 illustrates the whole constitution of a parking apparatus which is constituted by a parking fee receiving apparatus 10 and a leave-blocking apparatus 12 for locking a parking vehicle 11 installed in a parking zone 13, respectively.

Figure 1:
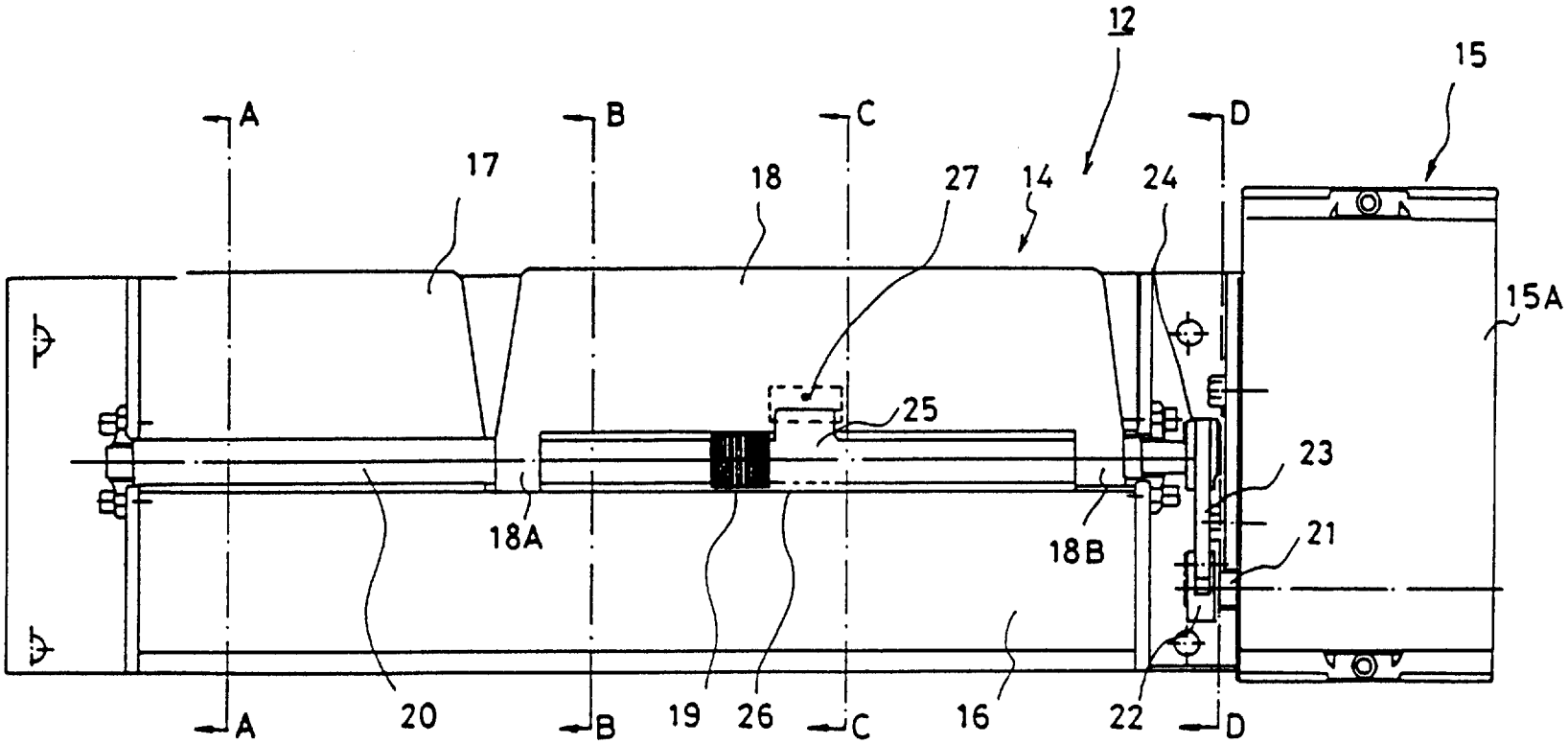
FIG. 1 is a plan view illustrating an embodiment of an apparatus for blocking a parking vehicle from leaving according to the present invention.
Figure 2:
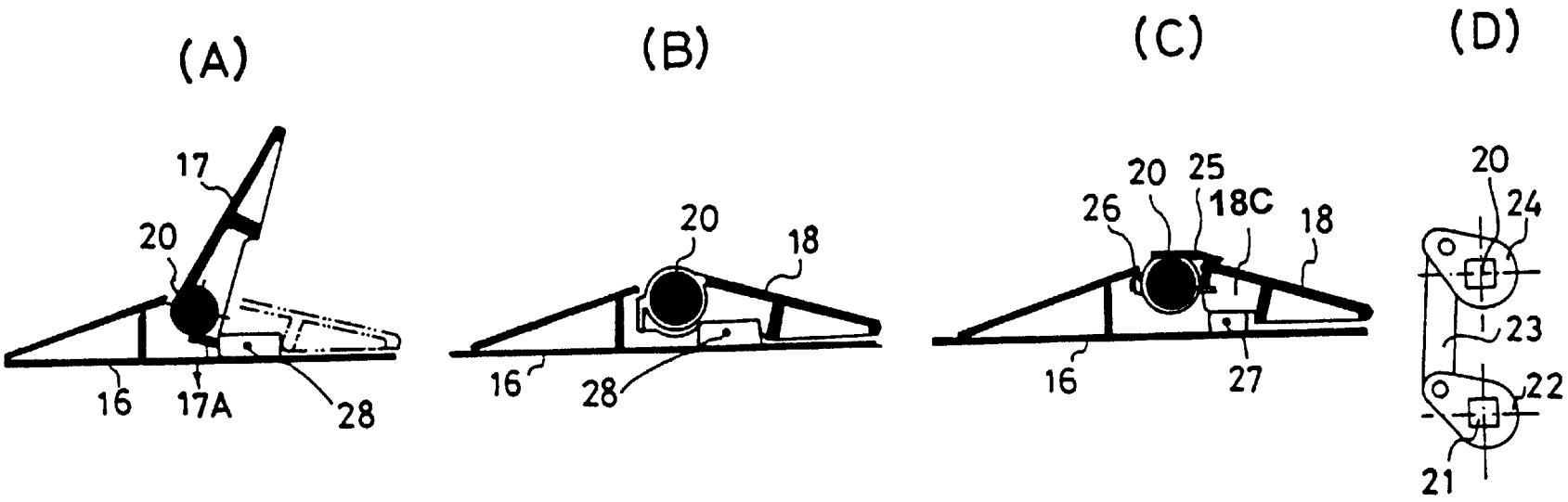
FIG. 2 is a side sectional view of the above-mentioned embodiment, wherein the diagram (A) is a sectional view along the arrow A—A in FIG. 1, the diagram (B) is a sectional view along the arrow B—B in FIG. 1, the diagram (C) is a sectional view along the arrow C—C in FIG. 1, and the diagram (D) is a sectional view along the arrow D—D in FIG. 1.

FIGS. 1 and 2 illustrate in detail the constitution of the leave-blocking apparatus 12.

In these drawings, the leave-blocking apparatus 12 is constituted by a vehicle-locking portion 14 and a drive portion 15.

The vehicle-locking portion 14 is provided with a base portion 16 installed on the installation surface, a main locking board 17 supported by the base portion 16, an auxiliary locking board 18 supported by the base portion 16, and a locking board shaft 20. The main locking board 17 is directly coupled to the locking board shaft 20 and the auxiliary locking board 18 is coupled, via a torsion coil spring 19 to the locking board shaft 20.

Here, the auxiliary locking board 18 has a lateral width that is larger than the lateral width of the main locking board 17. The main locking board 17 is disposed to the center of the parking zone 13 relative to the auxiliary locking board 18.

The locking board shaft 20 is supported by the two end walls of the base portion 16 such that its both ends are allowed to rotate.

The drive portion 15 includes a case 15A, a drive device constituted by an electric motor or the like contained in the case 15A and for selectively driving the main locking board 17 and the auxiliary locking board 18 to be in the elevated locked state and the lowered unlocked state, and a control circuit portion which is a control device for controlling the drive device in response to a sensing signal output from a vehicle sensor that is not shown, so that the main locking board 17 and the auxiliary locking board 18 are erected.

The drive device is constituted by a drive apparatus as represented by the one disclosed in Japanese Patent No. 1568088. A crank 22 is attached to a drive shaft 21 of the drive apparatus, the locking board shaft 20 is coupled to the crank 22 via a link 23 and a crank 24, and the driving force of the drive apparatus is transmitted to the locking board shaft 20 through drive shaft 21, crank 22, link 23 and crank 24, so that the main locking board 17 is driven and that the auxiliary locking board 18 is driven being interlocked to the main locking board 17 through an interlocking device which includes the torsion coil spring 19 as will be described later.

In describing the above-mentioned constitution in further detail, the main locking board 17 is secured at its base end by welding to the outer periphery of the locking board shaft 20 as a unitary structure together therewith.

The auxiliary locking board 18 has bearings 18A and 18B provided at the base end on both sides thereof, the bearings 18A and 18B being supported by the locking board shaft 20 so as to freely rotate. That is, the auxiliary locking board 18 is allowed to freely rotate about the locking board shaft 20.

A plate-like protruded portion 25 and a protruded portion 26 are fastened by screws (not shown) to a central portion of the locking board shaft 20 between the bearings 18A and 18B of the auxiliary locking board 18. The plate-like protruded portion 25 extends toward the end of the auxiliary locking board 18 from the outer peripheral surface of the locking board shaft 20 and the protruded portion 26 extends from the outer peripheral surface of the locking board shaft 20 toward a direction opposite to the protruded portion 25.

A coil portion of the torsion coil spring 19 is fitted to a portion of the locking board shaft 20 at a position near the two protruded portions 25, 26 between the bearings 18A and 18B of the auxiliary locking board 18, and the one end of the torsion coil spring 19 contacts and B anchored to the lower surface of the auxiliary locking board 18 and the other end thereof contacts and is anchored to the lower surface of the protruded portion 26.

The spring force of the torsion coil spring 19 acts toward the side to elevate the auxiliary locking board 18 to be in the locked state at all times.

The protruded portion 25 extends toward the side of the upper surface at the central portion of the base end between the pair of bearings 18A and 18B of the auxiliary locking board 18. The auxiliary locking board 18 is resiliently urged at all times by the torsion coil spring 19 toward the direction of elevation, and is at rest at all times at a position where it is in contact with the protruded portion 25. The rest position of the auxiliary locking board 18 is set so that it is nearly in parallel with the main locking board 17 when no external force is exerted thereon.

The combination of the torsion coil spring 19 and the protruded portion 25 correspond to the interlocking device of the present invention, and exhibits the following function.

When the drive shaft 21 is rotated to rotate the locking board shaft 20 causing the main locking board 17 to rotate into the elevated locked state, the auxiliary locking board 18, which that is resiliently urged by the torsion coil spring 19 at all times in the direction of elevation turns such that it is in contact with the protruded portion 25, which together with the locking board shaft 20, and is elevated into the locked state. In this case, the main locking board 17 is in the locked state accompanying the turn of the drive shaft 21, while the auxiliary locking board 18 is in the pseudo locked state based on the spring force of the torsion coil spring 19, and can be lowered by the external force that acts against the spring force of the torsion coil spring 19.

In the unlocked state where the main locking board 17 is turned and is lowered, the auxiliary locking board 18 is turned and is lowered to be in the unlocked state while being held by the protruded portion 25 formed on the locking board shaft 20.

In FIGS. 1 and 2, reference numeral 27 denotes a pressure sensor working as a detection device for detecting that the auxiliary locking board 18 has been pushed down to the unlocked position during the locking period. The pressure sensor 27 is installed on the upper surface of the base portion 16 corresponding to a central portion of the lateral width of the auxiliary locking board 18.

When the auxiliary locking board 18 is pushed down, the pressure sensor 27 is depressed by a rib 18C which is secured by welding to the lower surface of the base end of the auxiliary locking board 18, and detects a pressure and produces a detection signal.

In FIGS. 1 and 2, reference numeral 28 denotes a stopper for limiting the elevated position of the main locking board 17 during the locking period. The stopper 28 is engaged an engaging piece 17A provided at the base end of the main locking board 17, so that the main locking board 17 is halted at a predetermined elevated position.

Described below is the operation of the above-mentioned constitution.

The drive apparatus is rotated in one direction in response to a fall-down signal from the control circuit portion. Then, the main locking board 17 is lowered and the auxiliary locking board 18 is lowered, too, owing to the action of the above-mentioned interlocking device, and both of them are in the unlocked state.

As the vehicle sensor senses the vehicle, the drive apparatus is driven by an instruction from the control circuit portion based on the sensing signal so as to turn in a direction opposite to the direction of rotation during the unlocking period. Accordingly, the main locking board 17 is elevated and the auxiliary locking board 18 is elevated, too, due to the action of the above-mentioned interlocking device, and both of them are in the locked state.

The thus constituted leave-blocking apparatus 12 exhibits the following effects.

That is, by constructing the locking portion with a plurality of locking boards, such as the main locking board 17 and the auxiliary locking board 18, at least one of the plurality of the locking boards, for example, the main locking board 17 in this embodiment, can be installed at a position remote from the tire, and at least one of the plurality of the locking boards, for example, the auxiliary locking board 18 in this embodiment can be installed at a position close to the driver's seat, i.e., at a position that will be run (passed) over by the tire. Therefore, despite the main locking board 17 being concealed just under the vehicle 11 in FIG. 5, which renders it difficult to confirm the locked state, the auxiliary locking board 18 installed at a position that will be run (passed) over by the tire makes it possible to easily confirm the elevated locked state of the locking boards 17 and 18 from the driver's seat which is close thereto. Besides, even when the driver carelessly leaves or leaves while the locking boards 17 and 18 are elevated, little trouble occurs.

When the driver tries to leave in an unauthorized manner without paying fees, the main locking board 17 installed at a position remote from the tire hits the vehicle body to block the vehicle from leaving.

In this embodiment, the locking board is constituted by the main locking board 17 and the auxiliary locking board 18. The main locking board 17 is interlocked with the drive apparatus. The main locking board 17 and the auxiliary locking board 18 are interlocked together so that the auxiliary locking board 18 can be actuated into the locked state or the unlocked state when the main locking board 17 is driven by the drive apparatus into the locked state or the unlocked state. Therefore, there is no need to directly drive the auxiliary locking board 18 by the drive apparatus, and the auxiliary locking board 18 can be easily installed at a position remote from the main locking board 17.

Moreover, the interlocking device is so constituted that the main locking board 17 and the auxiliary locking board 18 are interlocked together so that, when the main locking board 17 is driven to be in the locked state, the auxiliary locking board 18 being in the locked state can be actuated to be in the unlocked state upon the application of an external force. Therefore, when the auxiliary locking board 18 is lowered and run over by the tire, the operation of the main locking board 17 is not affected; i.e., the locked state is maintained in which the main locking board 17 is elevated. This prevents the vehicle from rising high and effectively prevents the vehicle from leaving in an unauthorized manner without paying fees.

Furthermore, the main locking board 17 is disposed near the center of the parking zone 13 in FIG. 5 relative to the auxiliary locking board 18, and the auxiliary locking board 18 has a lateral width greater than the lateral width of the main locking board 17. This makes it possible to prevent the main locking board 17 from being intentionally trod by the tire and, hence, to effectively prevent the vehicle from leaving in an unauthorized manner without paying fees.

By providing the pressure sensor 27, which detects when the auxiliary locking board 18 is in the locked state and is being pushed down as in this embodiment, it is possible to detect when the auxiliary locking board 18 is in the unlocked state is being driven over pushed down, for example, in an attempt to leave in an unauthorized manner. An alarm can then be produced by utilizing the detection signal, or the detection signal can be output to the external unit to take a picture of the vehicle using a camera or the like.

Moreover, when the driver has attempted to leave carelessly or to leave while the locking boards 17 and 18 are being elevated, the end of the auxiliary locking board 18 comes into contact with the tire, which can be noticed by the driver, making it possible to avoid troubles such as damaging the vehicle body.

Next, another embodiment of the present invention will be described with reference to FIGS. 3 and 4.

According to this embodiment, the direction of the main locking board 17 is opposite to that of the auxiliary locking board 18. To meet this, the interlocking device has a different constitution.

That is, the vehicle-locking portion 14 is provided with the main locking board 17, auxiliary locking board 18, a first locking board shaft 20A to which the main locking board 17 is directly coupled, and a second locking board shaft 20B to which the auxiliary locking board 18 is directly coupled.

The first locking board shaft 20A is coupled, via a joint 29, to the drive shaft 21 of the drive apparatus contained in the drive portion 15, and a crank 30 is coupled to the first locking board shaft 20A.

On the other hand, a crank 31 is coupled to the second locking board shaft 20B, the crank 31 being coupled to the crank 30 via a coil spring 32.

Owing to the provision of the cranks 30, 31 and the coil spring 32, the interlocking device according to the present invention is constituted in which the main locking board 17 and the auxiliary locking board 18 are coupled together so that, when the main locking board 17 is driven to be in the locked state or the unlocked state, the auxiliary locking board 18 is turned in a direction opposite to the main locking board 17 to be in the locked state or the unlocked state and that, when the main locking board 17 is driven to be in the locked state, the auxiliary locking board 18 that has been actuated to be in the locked state can be actuated to be in the unlocked state upon the application of an external force.

That is, when the crank 30 is turned in the direction of arrow a in FIG. 4(D) causing the main locking board 17 to elevate, the coil spring 32 is pulled and the crank 31 is turned in the direction of arrow b in FIG. 4(D) which is opposite to that of the crank 30, there by causing the auxiliary locking board 18 to elevate.

In this case, the main locking board 17 is in the locked state accompanying the turn of the drive shaft 21, whereas the auxiliary locking board 18 is in a pseudo locked state based on the spring force of the coil spring 32 and can be lowered upon the application of an external force greater than the spring force of the coil spring 32.

Conversely, when the crank 30 is turned in the direction of arrow c in FIG. 4(D) causing the main locking board 17 to be lowered, the coil spring 32 is no longer in the tensioned state, and the crank 31 turns in the direction of arrow d in FIG. 4(D) which is opposite to that of the crank 30, and the auxiliary locking board 18 is lowered.

The above-mentioned embodiment exhibits the same function and effect as those of the embodiment of FIGS. 1 and 2, and makes it possible to effectively prevent any attempt to leave in an unauthorized manner without paying fees.

In this embodiment as shown in FIG. 4(A), the end of the main locking board 17 is downwardly bent to avoid such troubles as damaging the vehicle body that occurs when the end of the main locking board 17 bites into the lower part of the vehicle body as a result of an attempt to leave in an unauthorized manner.

The constitution for downwardly bending the end of the main locking board 17 may also be applied even to the embodiment of FIGS. 1 and 2.

The end of the auxiliary locking board 18 may be downwardly bent, too.

This embodiment, too, is provided with the pressure sensor 27 for detecting that the auxiliary locking board has been pushed down to the unlocked position during the locking period, and with a stopper 28, to exhibit the same function and effect as those of the embodiment of FIGS. 1 and 2.

Figure 3:
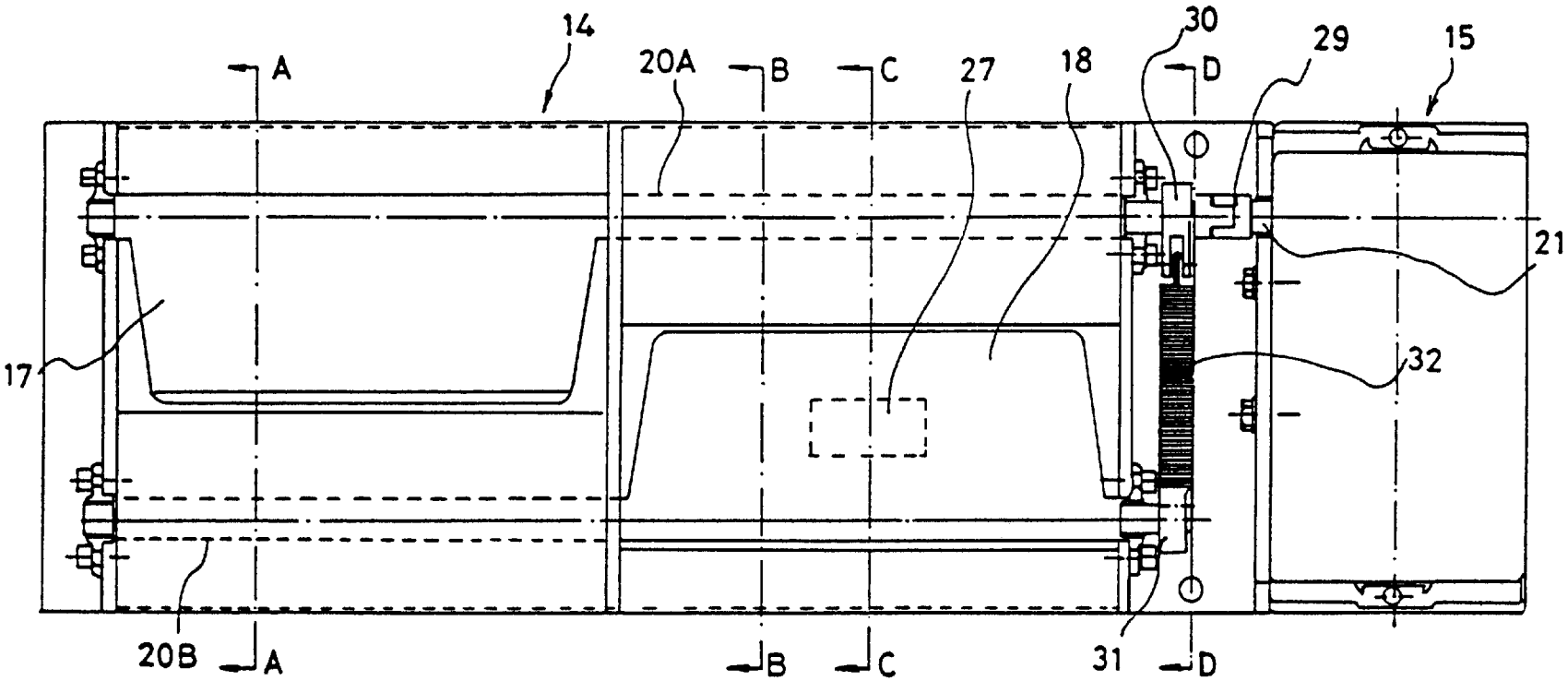
FIG. 3 is a plan view illustrating another embodiment of the apparatus for blocking a parking vehicle from leaving according to the present invention.
Figure 4:
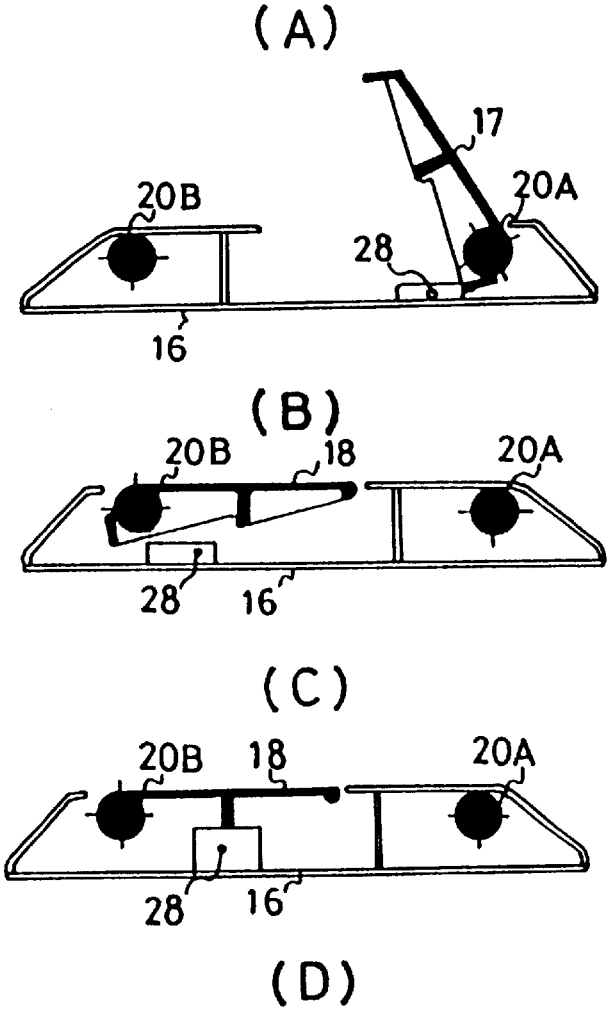
FIG. 4 is a side sectional view of the above-mentioned embodiment, wherein the diagram (A) is a sectional view along the arrow A—A in FIG. 3, the diagram (B) is a sectional view along the arrow B—B in FIG. 3, the diagram (C) is a sectional view along the arrow C—C in FIG. 3, and the diagram (D) is a sectional view along the arrow D—D in FIG. 3.

The directions of the main locking board 17 and of the auxiliary locking board 18 shown in FIGS. 3 and 4 may be reversed.

Industrial Applicability

According to the first aspect of the present invention as described above, the elevated state of the locking boards can be easily confirmed by a driver, and troubles occur little in case the driver has attempted to carelessly leave or to leave while the locking boards are being elevated. It is further possible to block the car from moving when it is attempted to leave in an unauthorized manner without paying fees. Accordingly it makes it possible to overcome a problem in that the locking boards that are elevated cannot be easily recognized by the driver, a problem in that troubles occur when the driver carelessly leaves or leaves while the locking boards are being elevated, and a problem related to any attempt to leave in an unauthorized manner without paying fees.

According to the second aspect of the present invention, it is allowed to effectively prevent any attempt to leave in an unauthorized manner without paying fees.

What is claimed is:

1. An apparatus for blocking a parking vehicle from leaving, comprising:

a locking portion including a main locking board and an auxiliary locking board, the main locking board being disposed at a central location such that a tire of the vehicle does not pass over the main locking board;

a drive element that selectively drives said main locking board into a locked state in which said main locking board is elevated and into an unlocked state in which said main locking board is lowered; and an interlocking element that couples the auxiliary locking board to the main locking board such that, when the main locking board is elevated into the locked state, the interlocking element elevates the auxiliary locking board and, when the main locking board is lowered into the unlocked state, the interlocking element lowers the auxiliary locking board, wherein said main locking board is rigidly coupled to said drive element.

2. An apparatus for blocking a parking vehicle from leaving according to claim 1, wherein at least a portion of an end of said main locking board is downwardly bent.

3. An apparatus for blocking a parking vehicle from leaving as claimed in claim 1, wherein said auxiliary locking board can be lowered into the unlocked state during the locked period.

4. An apparatus for blocking a parking vehicle from leaving as claimed in claim 1, wherein the auxiliary locking board is adapted to be lowered into the unlocked state by an external force during the locked state.

5. An apparatus for blocking a parking vehicle from leaving according to claim 1, wherein said main locking board is disposed near the central portion of the parking zone with respect to said auxiliary locking board.

6. An apparatus for blocking a parking vehicle from leaving according to claim 1, wherein said auxiliary locking board has a lateral width larger than the lateral width of the main locking board.

7. An apparatus for blocking a parking vehicle from leaving as claimed in claim 1, wherein, when a vehicle is parked over the blocking apparatus, the auxiliary locking board is visible, whereas the main locking board is not visible.

8. An apparatus for blocking a parking vehicle from leaving as claimed in claim 1, wherein, when a vehicle leaves a parked state and backs up, the auxiliary locking board is lowered into an unlocked state, whereas the main locking board remains in the locked state.

9. An apparatus for blocking a parking vehicle from leaving, comprising a locking portion for locking the parking vehicle, and a drive means for selectively driving said locking portion into a locked state in which said locking portion is elevated after said vehicle has entered for parking and into an unlocked state in which aid locking portion is lowered, wherein:

said locking portion is constituted by a main locking board and an auxiliary locking board;

said main locking board is interlocked to said drive means;

an interlocking means is provided to interlock said main locking board and said auxiliary locking board together so that said auxiliary locking board is actuated to be in the locked state or the unlocked state when said main locking board is driven by said drive means to be in the locked state or the unlocked state; and said interlocking means is so constituted as to interlock the main locking board and the auxiliary locking board together, so that said auxiliary locking board that is being in the locked state can be actuated by an external force to be in the unlocked state when said main locking board is driving to be in the locked state.

10. An apparatus for blocking a parking vehicle from leaving, comprising a locking portion for locking the parking vehicle, and a drive means for selectively driving said locking portion into a locked state in which said locking portion is elevated after said vehicle has entered for parking and into an unlocked state in which aid locking portion is lowered, wherein:

said locking portion is constituted by a main locking board and an auxiliary locking board;

said main locking board is interlocked to said drive means;

an interlocking means is provided to interlock said main locking board and said auxiliary locking board together so that said auxiliary locking board is actuated to be in the locked state or the unlocked state when said main locking board is driven by said drive means to be in the locked state or the unlocked state; and wherein said auxiliary locking board can be pushed down to the unlocked state during the locking period.

* * * * *